US011077488B2

(12) United States Patent
Bunting et al.

(10) Patent No.: US 11,077,488 B2
(45) Date of Patent: Aug. 3, 2021

(54) CASTING PROCESS WITH VARIABLE INDEX

(71) Applicants: Compagnie Generale des Etablissements Michelin, Clermont-Ferrand (FR); Jacob A Bunting, Greer, SC (US); Christopher Mast, Greenville, SC (US); Kevin C Miles, Clemson, SC (US); Joel Harrison, Simpsonville, SC (US)

(72) Inventors: Jacob A Bunting, Greer, SC (US); Christopher Mast, Greenville, SC (US); Kevin C Miles, Clemson, SC (US); Joel Harrison, Simpsonville, SC (US)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 0 days.

(21) Appl. No.: 17/051,348

(22) PCT Filed: May 11, 2018

(86) PCT No.: PCT/US2018/032364
§ 371 (c)(1),
(2) Date: Oct. 28, 2020

(87) PCT Pub. No.: WO2019/216916
PCT Pub. Date: Nov. 14, 2019

(65) Prior Publication Data
US 2021/0094091 A1 Apr. 1, 2021

(51) Int. Cl.
*B22C 5/04* (2006.01)
*B22C 5/18* (2006.01)
(Continued)

(52) U.S. Cl.
CPC ..... *B22C 9/02* (2013.01); *B22C 5/044* (2013.01); *B22C 5/18* (2013.01); *B22D 13/00* (2013.01); *B22C 9/22* (2013.01)

(58) Field of Classification Search
CPC ..... B22C 5/044; B22C 5/18; B22C 9/02
See application file for complete search history.

(56) References Cited

U.S. PATENT DOCUMENTS 4,121,646 A 10/1978 Rikker
4,190,369 A 2/1980 Rikker
(Continued)

FOREIGN PATENT DOCUMENTS

EP 2952597 A1 12/2015
JP S6368253 A 3/1988
JP 2008114265 A 5/2008

OTHER PUBLICATIONS

European Patent Office; International Search Report and Written Opinion for patent application PCT/US2018/032364, filed May 11, 2018; Publisher: European Patent Office, Rijswijk, Netherlands; dated Jun. 29, 2018; pp. 1-11, enclosed.

*Primary Examiner* — Kevin E Yoon
(74) *Attorney, Agent, or Firm* — Neal P. Pierotti

(57) ABSTRACT

A casting method is provided that includes a mold, a mixer, and first and second materials. A first pour and a second pour are dispensed from the mixer. The first pour has different proportions of the first and second materials as compared to the second pour. The first pour forms a first layer of a molded part, and the second pour forms a second layer of the molded part.

15 Claims, 4 Drawing Sheets

(51) Int. Cl.

| | |
|---|---|
| ***B22C 9/02*** | (2006.01) |
| ***B22D 13/00*** | (2006.01) |
| *B22C 9/22* | (2006.01) |

(56) References Cited

U.S. PATENT DOCUMENTS

| | | | | |
|---|---|---|---|---|
| 6,669,770 | B1 | 12/2003 | Goodwin | |
| 2015/0315083 | A1* | 11/2015 | Deters | B22C 1/188 164/16 |
| 2016/0221262 | A1* | 8/2016 | Das | B29C 35/0805 |
| 2018/0297232 | A1* | 10/2018 | Kraleti | B22C 9/22 |

* cited by examiner

CASTING PROCESS WITH VARIABLE INDEX

CROSS-REFERENCE TO RELATED APPLICATIONS

The present application is a 35 U.S.C. § 371 application of PCT/US18/32364 filed on May 11, 2018 and entitled "Casting Process with Variable Index." PCT/US18/32364 is incorporated by reference herein in its entirety for all purposes.

FIELD OF THE INVENTION

The subject matter of the present invention relates to a casting process for forming molded parts. More particularly, the present application involves a casting process in which material is poured into a mold from a mixing head that receives different amounts of material so that the resulting molded section has layers of varying material amounts with different associated properties.

BACKGROUND OF THE INVENTION

Casting is a manufacturing process in which a mold is provided for receiving a material in liquid form. The mold includes a void of desired shape and the liquid material is poured into this void and allowed to harden into solid form. Once hardened, the cast material is removed from the mold, and if desired subsequently machined to remove casting artifacts such as mold lines or to achieve a desired final product. Various forms of casting exist such as centrifugal casting, sand casting, die casting, and investment casting. The liquid material can be poured into the mold under atmospheric pressure, or may be inserted into the mold under a higher pressure. In centrifugal casting, a permanent mold is spun at high speeds about its axis and the liquid material is poured into this permanent mold. The liquid is pushed up against the walls of the mold due to the imparted centrifugal force and solidifies once cooled.

Mixing chambers are known for use in mixing two or more materials therein through the use of a blade. Injectors are in fluid communication with the mixing chamber and can inject material into the mixing chamber for subsequent mixing. Typically, each injector will inject its own type of material into the mixing chamber. Injection of the various materials into the mixing chamber, accompanied by subsequent mixing within the mixing chamber, produces a resulting liquid composed of the various materials. This resulting liquid may be known as a pour, and this pour is then subsequently dispensed into the void of the mold where it will eventually solidify into the desired shape. Although such casting processes are able to produce molded parts, they are incapable of producing discrete layers (without off ratio transition zones) of a molded part that feature different materials to achieve different characteristics in these different layers. As such, there remains room for variation and improvement within the art.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of identical or similar reference numerals in different figures denotes identical or similar features.

DETAILED DESCRIPTION OF THE INVENTION

Figure 1:
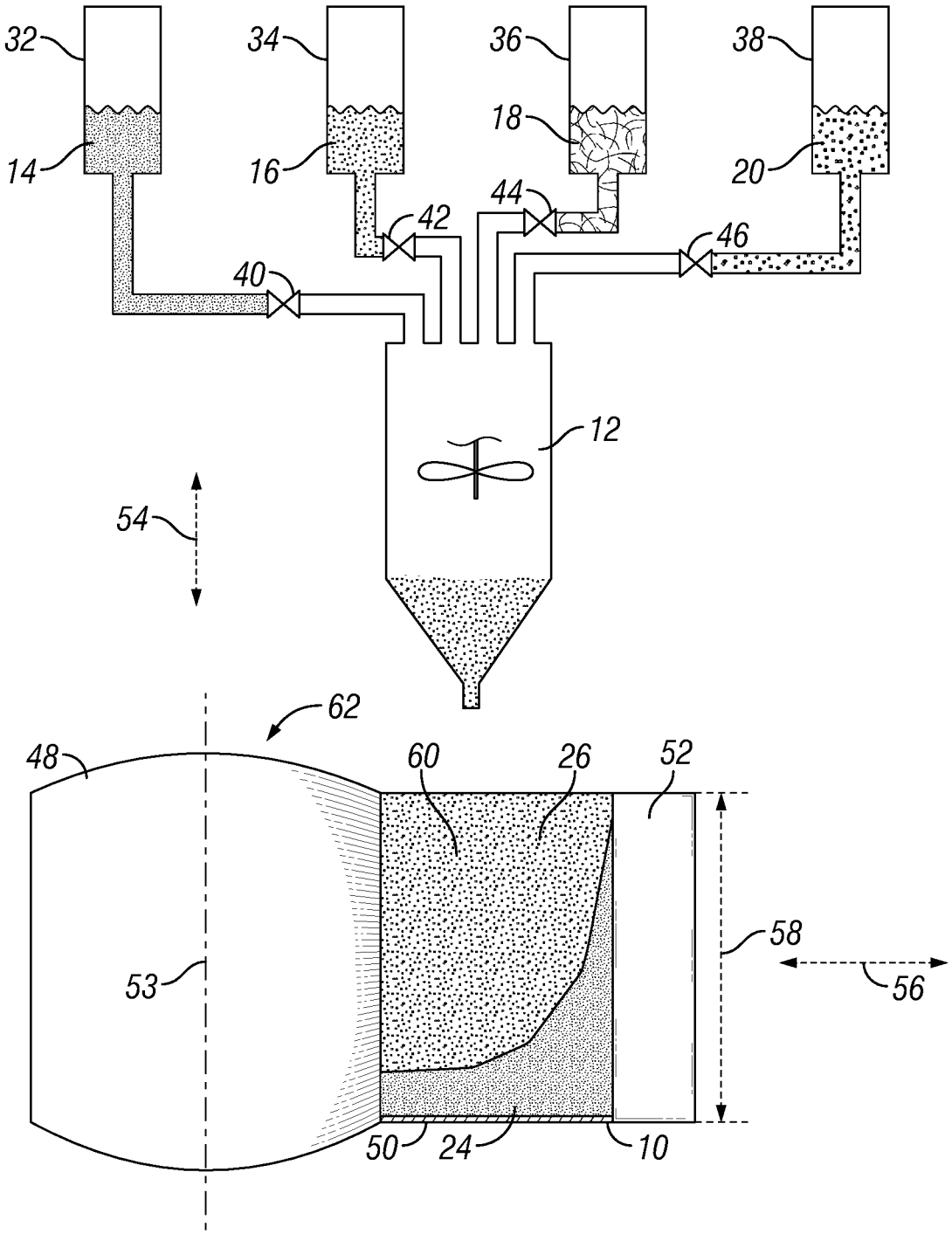
FIG. 1 is a schematic view of a method of casting a molded item in which two layers are present in a part of the molded item.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The present invention provides for a method of casting a molded item 62 that includes a part 60 that is made from multiple layers 24, 26. The multiple layers 24, 26 can be made of multiple materials 14, 16, 18, 20 such that the different layers 24, 26 include proportions of the materials 14, 16, 18, 20 different from one another. By the use of different proportions, the layers 24, 26 will exhibit different properties so that the molded part 60 will have different functionality in desired areas. For instance, the first layer 24 could have a proportion of materials 14, 16, 18, 20 that result in a greater bonding performance as compared to the second layer 26 that has materials 14, 16, 18, 20 that result in better crack resistance than the first layer 24. The use of multiple layers 24, 26 with different properties allows one to optimize the design of the cast part 60 of the molded item 62.

FIG. 1 is a schematic view that illustrates components of an embodiment of a casting method that can produce a molded item 62. The method includes a mold 10 that has a void 50 into which layers 24, 26 of material 14, 16, 18, 20 are placed to form the molded item 62. The first material 14 is located within a first injector 32. In a similar manner, the second material 16 is in a second injector 34, the third material 18 is in a third injector 36, and a fourth material 20 is in a fourth injector 38. The injectors 32, 34, 36, 38 can be configured in a variety of manners. In some instances, the injectors 32, 34, 36, 38 are tanks that hold the materials 14, 16, 18, 20, while in others the injectors 32, 34, 36, 38 are capable of applying pressure to the materials 14, 16, 18, 20 to force them out and to a desired location. A pressure head in the injectors 32, 34, 36, 38 may hold the materials 14, 16, 18, 20 at a flow pressure in which they want to move through an outlet of the injectors 32, 34, 36 38 downstream through a conduit and into a mixer 12. Although described as having injectors, the present method is not injection molding but is instead a casting process. In some arrangements, the system may be an open system. A pump or pumps can be used, not shown, that function to add pressure to the system to cause the materials 14, 16, 18, 20 to be urged toward the mixer 12.

A first valve 40 is in the conduit leaving the first injector 32 and can be opened or closed to allow or prevent the flow of the first material 14 into the mixer 12. In a similar manner, a second valve 42 is in the conduit leaving the second injector 34, a third valve 44 is in the conduit leaving the third injector 36, and a fourth valve 46 is in the conduit leaving the fourth injector 38. The valves 42, 44, 46 can likewise be opened and closed to control the flow of the materials 16, 18, 20 to the mixer 12. Although described as being in the conduits, the valves 40, 42, 44, 46 could instead be located at the mixer 12, or located at the outlets to the injectors 32, 34, 36, 38. The mixer 12 is a device that receives the various materials 14, 16, 18, 20 and mixes them, for example through the use of one or more blades or through rotation of the entire device, and then outputs the mixed materials 14, 16, 18, 20 in the form of a pour 22. The mixer 12 could in some instances apply heat to the materials 14, 16, 18, 20 assist in the mixing process. The pump could provide the flow rate of the materials 14, 16, 18, 20 to the mixer 12, but toggling of the valve 40, 42, 44, 46 can change the flow rate of the material 14, 16, 18, 20 to the mixer 12 to be zero to change instantaneously the proportion of the materials 14, 16, 18, 20 in the injector. Closing of the valve 40, 42, 44, 46 causes the stream of the material 14, 16, 18, 20 to recirculate back to a tank/injector 32, 34, 36, 38 in a recirculation loop at the same flow rate the material 14, 16, 18, 20 would have entered the mixer 12. Although described as employing a pump, it is to be understood that the preferred embodiment of the process does not use a pump to force the materials 14, 16, 18, 20 through the system to the mixer 12 or otherwise. Instead, in the preferred embodiment, injectors 32, 34, 36, 38 are provided for urging the materials 14, 16, 18, 20 to the mixer 12 and can turn on or off to instantaneously to start or stop flow of one of the materials 14, 16, 18, 20 for changing proportions of the pours 22.

The mixed materials 12, 16, 18, 20 are dispensed from the mixer 12 into a void 50 of the mold 10 to form a part 60 of the molded item 62. In the embodiment shown, the mold 10 before pouring of the materials 12, 16, 18, 20 includes a first piece 48 through which a central axis 53 is located. The central axis 53 extends in the axial direction 54, and the axial direction 54 is parallel to the central axis 53. A radial direction 56 extends outward away from the central axis 53. A second piece 52 in the mold 10 is positioned so as not to engage the first piece 48, and is spaced from the first piece 48 in the radial direction 56. The first and second pieces 48, 52 can be formed pieces that are subsequently put into the mold 10 so that the molded part 60 is then molded and attached to the first and second pieces 48, 52. Alternatively, the first and/or second piece 48, 52 can themselves be formed in the mold 10 itself either before or after the formation of the molded part 60. The mixer 12 may be used to form these pieces 48, 52 or they can be formed by other means. Although the molded item 62 is shown as being constructed of two pieces 48, 52 and the molded part 60, any number of pieces and molded parts can be used in other embodiments.

The molded part 60 of the molded item 62 is shown as having two layers 24, 26. The first layer 24 is poured first into the void 50 followed by the formation of the second layer 26. The second piece 52 has an axial length 58 that extends in the axial direction 54. The first layer 24 engages the second piece 52 and extends along a majority of the axial length 58. As shown, the second layer 26 likewise engages the second piece 52, but only extends along a minority of the axial length 58. In different embodiments, the first layer 24 may extend at least 51% of the axial length 58, at least 60% of the axial length 58, at least 75% of the axial length 58, at least 80% of the axial length 58, at least 90% of the axial length 58, or along 100% and thus all of the axial length 58. Only two layers 24, 26 are present and make up the part 60. In other embodiments, from 3-5 layers, from 6-10 layers, from 11-15 layers, or up to 20 layers may be present and make up the part 60. The first layer 24 is made of a different proportion of the materials 14, 16, 18, 20 than the second layer 26 and thus has different performance properties than the second layer 26. Any number of layers can be present in the part 60 in different embodiments formed through the disclosed process. Some of the layers may include the same proportions of the materials and thus have the same performance properties as one another, while other layers have different proportions of materials and function differently than other layers of the part 60.

Figure 2:
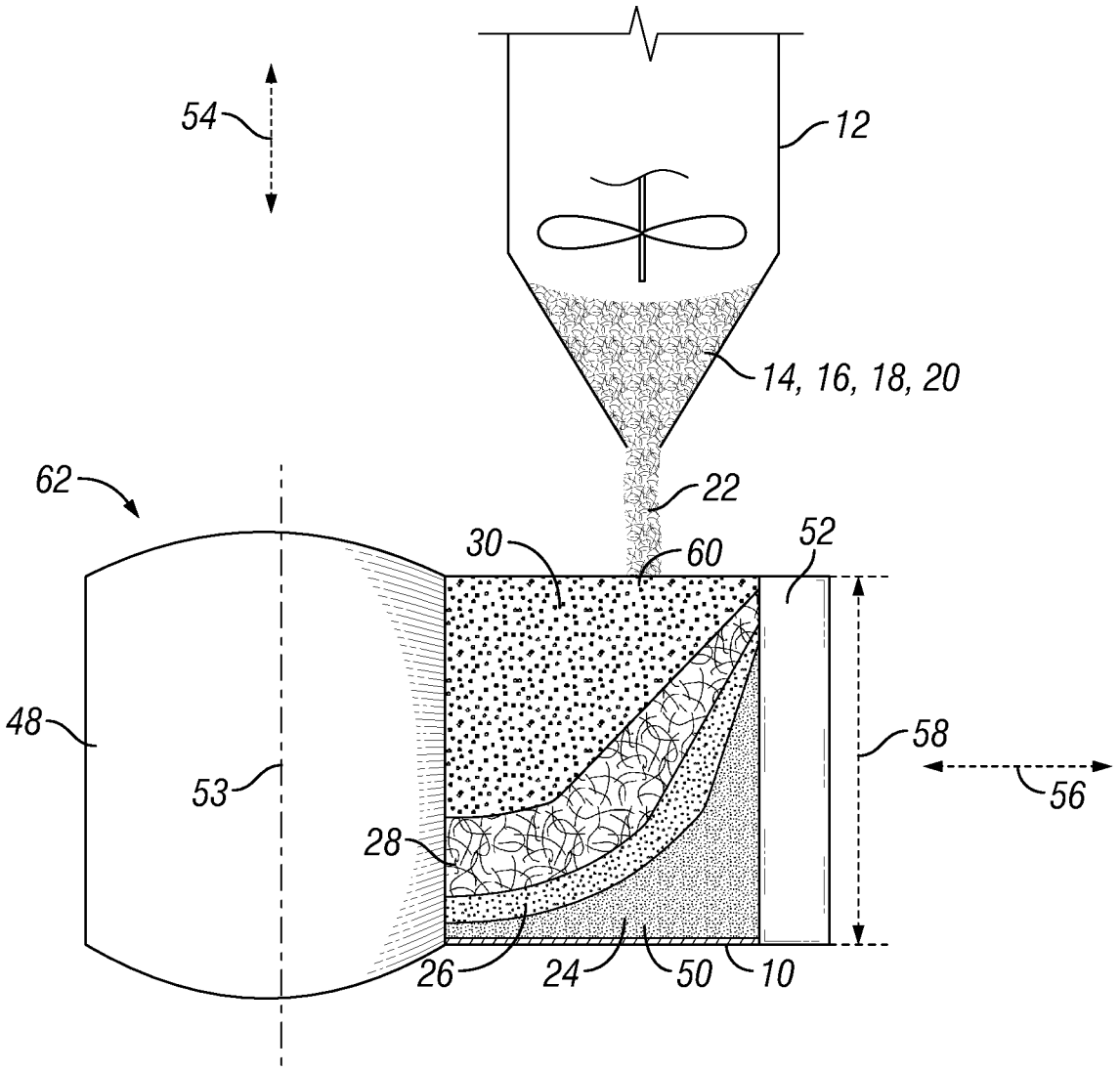
FIG. 2 is a schematic view of a method of casting a molded item in which four layers are present in a part of the molded item.

FIG. 2 is a schematic view of the process in another embodiment in which the part 60 is made of four layers 24, 26, 28, 30. The part 60 includes only the four layers and no more in this embodiment. The mold 10 likewise includes the first piece 48 and the second piece 52 and the molded part 60 is formed between these two pieces 48, 52 to form the molded item 62. The first layer 24 can include the same proportion of materials 14, 16, 18, 20 as does the third layer 28. The second layer 26 can include a different proportion of materials 14, 16, 18, 20 than the first and second layers 24, 28, but may include the same proportion of materials 14, 16, 18, 20 as does the fourth layer 30. The first and third layers 24, 28 thus enjoy the same functional properties as one another which are different than the second and fourth layers 26, 30 that in turn have the same function properties as one another. The placement of the layers 24, 26, 28, 30 within the molded part 60 with different properties allows one to exploit the use of different performance properties at different locations of the molded part 60. The four layers 24, 26, 28, 30 are all formed by pours 22 from the mixer 12, and as shown the final layer which is the fourth layer 30 is still being formed by the pour 22 exiting the mixer 12 and entering the void 50 on top of the third layer 28. The four layers 24, 26, 28, 30 are arranged so that the first layer 24 engages a majority of the axial length 58. The second, third and fourth layers 26, 28, 30 also engage the second piece 52 but even combined do not engage as much of the axial length 58 as does the first layer 24. The layers are overlapped onto one another so that in the piece 60 they engage only the preceding and the subsequently formed layers. In this regard, the first layer 24 engages only the second layer 26 and does not engage the third or fourth layers 28, 30. The second layer 26 engages only the first and third layers 24, 28, and not the fourth layer 30. The third layer 28 engages only the second and fourth layers 26, 30 and not the first layer 24. Finally, the fourth layer 30 only engages the third layer 28 and does not engage the first or second layers 24, 26. All of the layers 24, 26, 28, 30 engage the first piece 48.

An example of executing the process of molding the molded item 62 may now be discussed. With reference first to FIG. 1, the mold 10 is provided with both the first piece 48 and the second piece 52 with the void 50 therebetween for formation of the molded part 60. A first material 14 is provided that is curative, the second material 16 is prepoly, the third material 18 is a catalyst diluted in curative, and the fourth material 20 is a colorant. Injectors 32, 34, 36, 38 store their respective materials 14, 16, 18, 20 under a head pressure sufficient to cause them to flow downstream to the mixer 12. The valves 40, 42, 44, 46 are all initially closed so that none of the materials 14, 16, 18, 20 are initially sent to the mixer 12. When the mold 10 is ready to receive pour 22, the valves 40, 42, 44, 46 may all be opened at the same time and the materials 14, 16, 18, 20 dispensed into the mixer 12 where a blade or other mechanism mixes all of the materials 14, 16, 18, 20. At some point, the first valve 40 is closed and the curative 14 is no longer provided to the mixer 12 while the remaining materials 16, 28, 20 are in fact provided to the mixer 12. Other ones of the valves 16, 18, 20 could likewise be closed to cause any one(s) of the prepoly 12, catalyst diluted in curative 18, or colorant 20 to be provided to the mixer 12 in a lesser amount than the others. Once the correct mix is obtained, the mixer 12 can dispense a first pour 22 of the materials 14, 16, 18, 20 in which the materials 14, 16, 18, 20 are present in a particular proportion to one another. The amount of materials 14, 16, 18, 20 can be measured in a variety of ways and thus the proportion of materials 14, 16, 18, 20 can likewise be calculated in different manners. For example, the amount of materials 14, 16, 18, 20 can be expressed in terms of their individual volumes (ml) dispensed into the mixer 12, in terms of their weight (grams) dispensed into the mixer 12, or in terms of the amount of flow (g/min) from the injectors 32, 34, 36, 38 into the mixer 12. The proportion of the various materials 14, 16, 18, 20 can be expressed in terms of a percentage to one another or to its overall contribution to the total amount of the mix. As an example, in the first pour 22 the curative 14 may be in a proportion of 1% of the overall mix while the prepoly 16 is 88% of the overall mix, the catalyst diluted in curative 18 is 10% of the overall mix, and the colorant is 1% of the overall mix. The first material curative 14 is also provided at a certain mass as being 1 gram and the second material prepoly 16 may be expressed as being 88 grams.

Once the desired mix is present in the mixer 12, the first pour 22 is dispensed from the mixer 12 into the void 50 of the mold 10. Spin casting may be employed in that the mold 10 is spun about its axis 53 once the first pour 22 is dispensed into the void 50. This spinning causes the liquid making up the first pour 22 to be pushed via centrifugal force outward in the radial direction 56 against the second piece 52. The liquid of the first pour 22 will thus assume the shape shown in FIG. 1 and harden into the first layer 24.

A second charge can be dispensed into the mixer 12 for subsequent dispensing into the mold 10 as a second pour 22. The proportions of the curative 14, prepoly 16, catalyst diluted in curative 18, and colorant 20 in the second pour 22 is different than those of the first pour 22. In this regard, the valves 14, 16, 18, 20 may all open to dispense their respective materials 14, 16, 18, 20 into the mixer 12. The amount of time the first valve 40 is open is greater when generating the second pour 22 than the first pour 22 (the first valve 40 may not be open in the first pour 22) so that a larger amount of the curative 14 is present in the second pour 22 in proportion than in the first pour 22. Again, the remaining valves 42, 44, 46 could be closed before or at the same time as one another to achieve desired proportions of the prepoly 16, catalyst diluted in curative 18 and colorant 20 in the second pour 22. In one embodiment, in the second pour 22 the curative 14 may be in a proportion of 2% of the overall mix while the prepoly 16 is 87% of the overall mix, the catalyst diluted in curative 18 is 10% of the overall mix, and the colorant is 1% of the overall mix. The first material curative 14 is also provided at a certain proportion to the second material prepoly 16, and this proportion may be expressed as being 1 to 44. The valves 40, 42, 44, 46 could be open different amounts, or open for different lengths of time to achieve the desired metering of the materials 14, 16, 18, 20 into the mixer 12. Of course, instead of opening the valves 40, 42, 44, 46 for different amounts of time to achieve the desired mix of materials 14, 16, 18, 20 in the mixer 12, other means are possible such as adding pressure to one of the lines to get a greater amount of flow, or having two lines of the same material inject that material into the mixer 12 to get a larger volume of that particular material.

The mixer 12 mixes the second pour 22 and then dispenses it into the void 50 on top of the first layer 24. The mold 10 can be spun about its axis 53, or may remain stationary as the second pour 22 will only fill the remaining void 50 not already filled by the first layer 24. The liquid of the second pour 22 will harden into the second layer 26 and fill the void 50. The molded item 62 can then be removed from the mold 10 and subsequently machined or finished if necessary. The molded part 60 connects the two pieces 48 and 52 and includes layers 24, 26 with different proportions of materials 14, 16, 18, 20 so that the different layers 24, 26 provide different functionality at select, different locations in the molded item 62. The first layer 24 has a smaller proportion of the curative 14 and is rich in the prepoly 16. This arrangement, along with the fact the first layer 24 extends along a majority of the axial length 58, causes a stronger bond to be formed between the second piece 52 and the molded part 60 than in the case where there was less prepoly 16 since the prepoly 16 acts as an adhesive agent. The second layer 26 is present in a greater volume in the part 60 and is rich in the curative 14 which functions to reduce crack propagation in the molded part 60. This reduction of crack propagation is desirable in this area of the part 60 because this area is not primarily in engagement with the second piece 52 and does not have to function primarily in attaching the molded part 60 to the second piece 52. The first and second pours 22 can be dispensed for different amounts of time so that they have different volumes, amounts within the part 60. In other arrangements, all of the layers have the same amount, volume within the part 60.

Other versions of the molding method are possible in which the valve 40 is toggled on and off while constant flow is metered through the other valves 42, 44, 46 so that multiple pours are produced forming multiple layers 24, 26, 28, 30 in the part 60 as shown for example in FIG. 2. The mold 10 can be spun about axis 53 to produce layers 24, 26, 28, 30 that are pushed outwards in the radial direction 56 towards the second piece 52. Toggling the valve 40 results in the layers 24, 26, 28, 30 having alternating proportions of the curative 14 so that the layers 24, 26, 28, 30 alternate in being rich in prepoly 16, and then rich in curative 14 so that the layers 24, 26, 28, 30 have different properties. A computer having a microprocessor can be in communication with the injectors 32, 34, 36, 38, the valves 40, 42, 44, 46, the mixer 12, and the mold 10 so that the process of forming the part 60 is automated such that the components work in order and concert with one another. The microprocessor can be programmed with different pour 22 recipes so that the machine can charge the mixer 12 with the appropriate amount of materials 14, 16, 18, 20.

The molded item 62 that is formed can be a piece that supports a vehicle and that functions without the use of a fluid. The first piece 48 can connect to the wheel of the vehicle, and the second piece 52 can hold the piece together and may provide a base for engagement with the road. The molded part 60 connects these pieces 48, 52 together and can hold the molded item 62 in tension. Although a single molded part 60 is shown, many voids 50 can be present in the mold 10 and a plurality of molded parts 60 can be formed in the molded item 62 spaced from one another in the circumferential direction.

Figure 3:
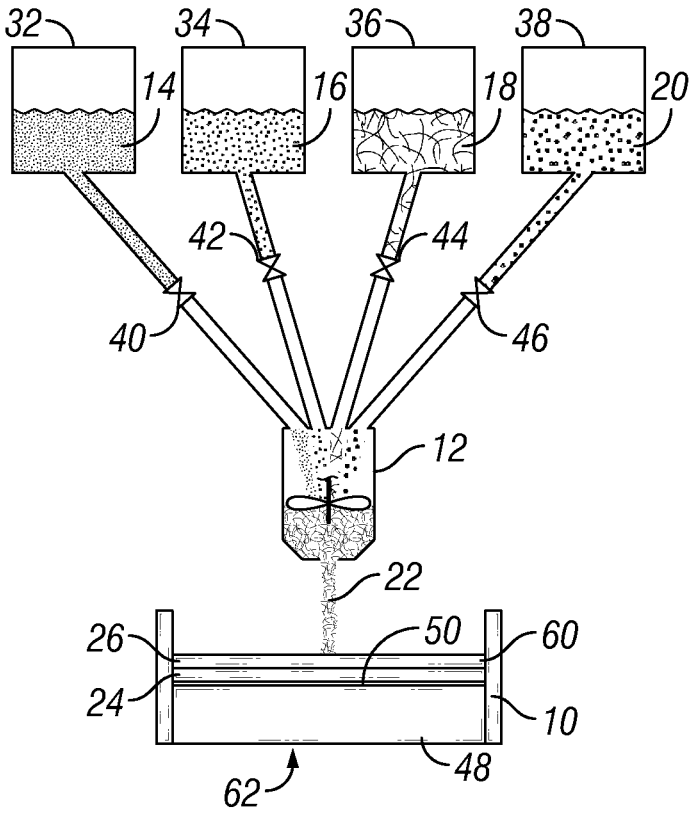
FIG. 3 is schematic view of a method of casting a molded item that is not spun in a mold when cast.

The present method can be used to construct molded items 62 of various types other than just those used to support vehicles. FIG. 3 shows an embodiment of the method in which four materials 32, 34, 36, 38 are again used and are dispensed via the opening and closing of valves 40, 42, 44, 46 into the mixer 12. The materials are the same as previously discussed in that the first material 14 is curative, the second 16 prepoly, the third 18 catalyst diluted in curative, and the fourth 20 colorant. The first material 14 can be metered into the mixer 12 so that the first pour 22 has a different proportion of the first material 14 than the subsequent second pour 22. The mold 10 is provided with a previously formed first piece 48 and the first pour 22 that has a higher proportion of the prepoly as compared to the second pour 22. The first pour 22 engages the first piece 48 and forms the first layer 24 in the mold 10. The layer 24 has a higher proportion of the prepoly so that it forms a better bond with the first piece 48.

Figure 4:
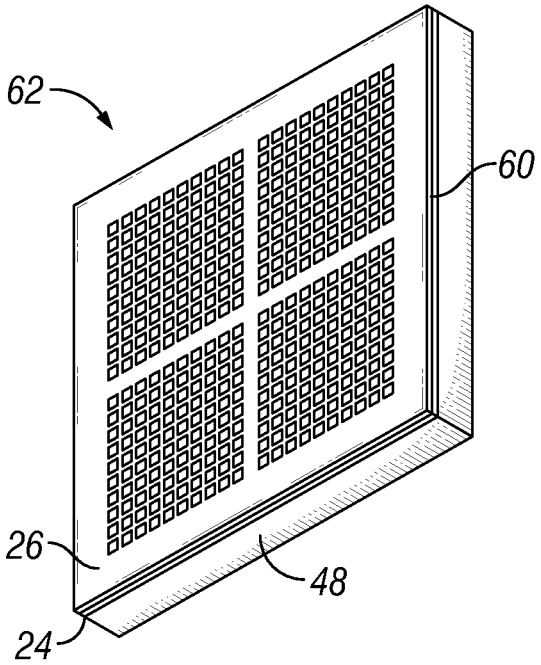
FIG. 4 is a perspective view of a molded item that is a screen made from the process shown in FIG. 3.

The first valve 40 can be toggled open or can be opened for a longer amount of time so that a larger amount of the curative 14 is inserted into the mixer 12 in proportion to the other materials 16, 18, 20. The second pour 22 can then be dispensed from the mixer 12 into the mold 10 to form the second layer 26 that has a lesser proportion of the prepoly 16 than the first layer 24. The mold 10 can be a static mold and need not spin in this embodiment. Once the desired amount of the second pour 22 is reached, the second pour 22 can be stopped from the mixer 12 and the part 60 can be allowed to solidify to form the molded item 62. The molded item 62 is shown in FIG. 4 and is a screen that includes the part 60 made from layers 24, 26 having different proportions of the first material 14.

Figure 5:
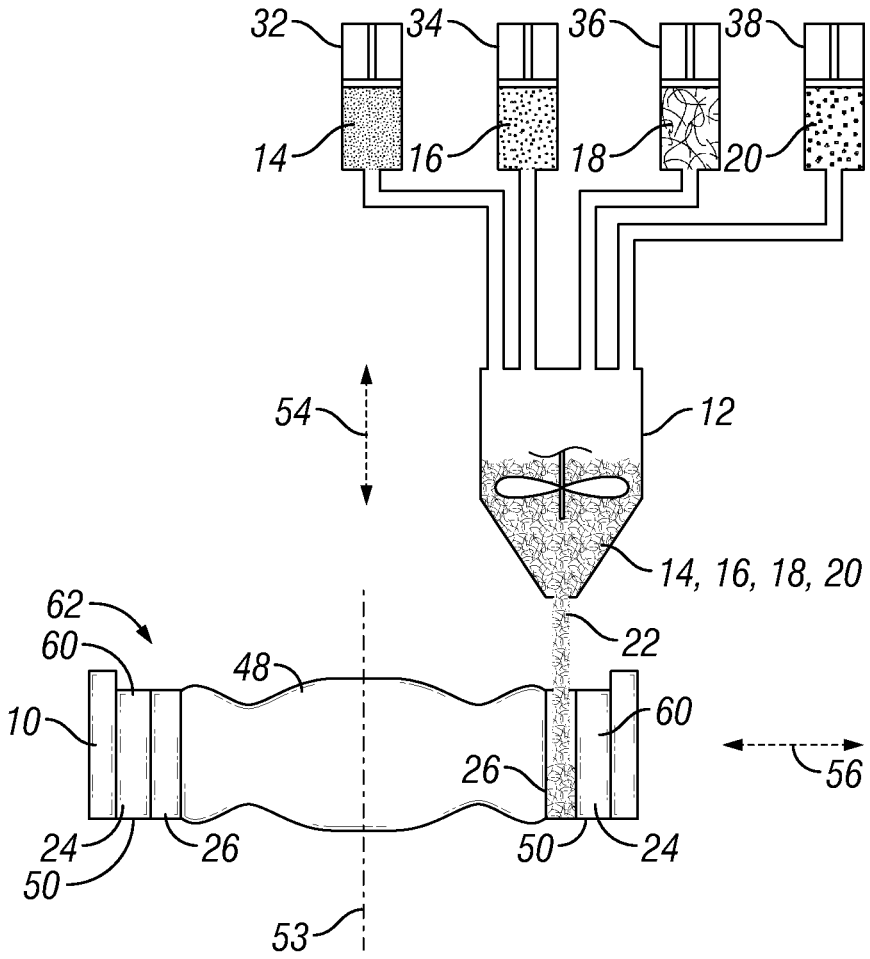
FIG. 5 is schematic view of a method of forming a molded item in which two layers are present in a part of the molded item.
Figure 6:
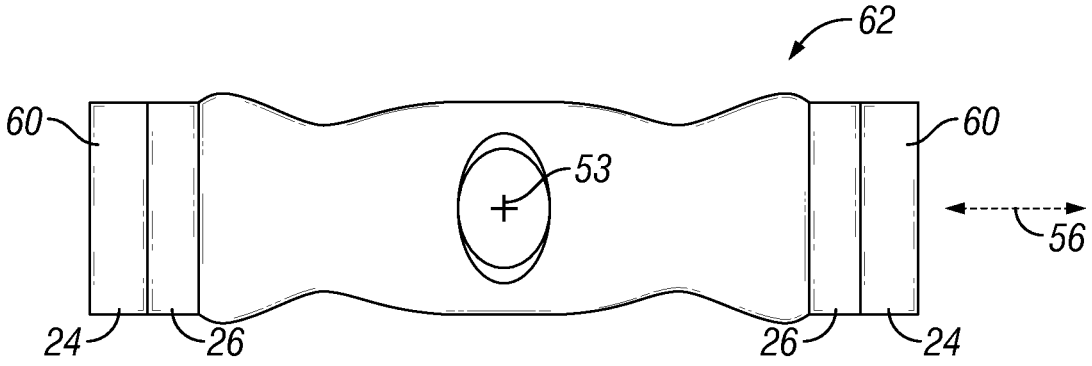
FIG. 6 is a top view of a molded item that is a screen made from the process shown in FIG. 5.

Another arrangement of the method is illustrated with respect to FIGS. 5 and 6 in which the method is used to form a molded item 62 that is a hammer head. The valves 40, 42, 44, 46 are not present. Instead, the materials 14, 16, 18, 20 are located in injectors 32, 34, 36, 38 that apply pressure to them to force them into the mixer 12. In so far as valves 40, 42, 44, 46 could though to be present, they may be part of the injectors 32, 34, 36, 38 and open and close in response to actuation of the injectors 32, 34, 36, 38. The injectors 32, 34, 36, 38 may be in communication with a microprocessor and can dispense the materials 14, 16, 18, 20 into the mixer 12 in proportions as desired. The materials 14, 16, 18, 20 are mixed in the mixer 12 and are then dispensed in a first pour 22 into the mold 10. The mold 10 may be spun about its axis 53 so that the first pour 22 is forced against the walls of the mold 10 in the radial direction 56. Upon cooling of the liquid of the first pour 22, a first layer 24 is formed. The mold 10 can have two voids 50, and the first pour 22 can be poured into both of the voids 50 so that two first layers 24 are formed which make up the two striking surfaces of the hammer head 62.

The injectors 32, 34, 36, 38 may vary the amount of material injected into the mixer 12 so that the resulting second pour 22 has different proportions of the materials 14, 16, 18, 20 than does the first pour 22. The second pour 22 can be dispensed into the remaining portions of the voids 50 to complete the part 60. The hammer head 62 may be spun upon pouring of the second pour 22, or may not need to be spun about its axis 53 because the second pour 22 does not need to be positioned in the radial direction 56 for formation of the second layer 26. Once formed, the first layer 24 forms the entire striking surface of the hammer head 62, and the second layer 26 does not form any part of the striking surface, but does function to connect the first layer 24 to the rest of the hammer head 62.

The different proportions between the first layer 24 and the second layer 26 has been described in relation to the first material 14 being present in the first layer 24, but of a smaller proportion in the first layer 24 than in the second layer 26. However, in certain embodiments the first material 14 is not present at all in the first layer 24, but is present in the second layer 26. In these instances, the proportion of the first material 14 is still different between the first 24 and second 26 layers because it is a proportion of zero in the first layer 24, and is some non-zero proportion in the second layer 26. Further, although described in relation to the use of four materials 14, 16, 18, 20, it is to be understood that this number is only exemplary and that any number of materials 14, 16, 18, 20 including and over at least two materials 14, 16, 18, 20 may be present in other embodiments of the method of forming the part 60. In other embodiments of the process, 2 materials, 3 materials, 5 materials, from 6-10 materials, or up to 50 materials are employed in the various pours. In some embodiments, all of the pours 22 have the same materials, although again their proportions may be different between at least two of the pours 22. In other embodiments, not all of the same materials 14, 16, 18, 20 are present in all of the pours 22 such that some pours 22 have more materials 14, 16, 18, 20 than others, while other pours 22 features fewer of the materials 14, 16, 18, 20 found in other pours 22 making up the part 60. As a consequence, the resulting part 60 may features layers 24, 26, 28, 30 that all have the same materials 14, 16, 18, 20, or may have layers 24, 26, 28, 30 that have different materials 24, 26, 28, 30 from one another.

The dispensing of the materials 14, 16,18, 20 into the mixer 12 may be made so that all of the material 14, 16, 18, 20 in the mixer 12 is dispensed in the pour 22 before the next layer 26, 28, 30 is desired to be created. Alternatively, once one of the layers 24, 26, 28, 30 is finished the mixer 12 may still retain some of the materials 14, 16, 28, 20 therein. Depending upon the cool time of the layers 24, 26, 28, 30 the process can be continuous as the mixer 12 may constantly be receiving a charge of the materials 14, 16, 18, 20. In some instances, the pours 22 may be dispensed into the mold 10 before the previous layer 24, 26, 28, 30 is even cooled and remains liquid. The method may function by toggling one or more of the valves 40, 42, 44, 46 during the pours, instead of by changing the flow rates of the materials 14, 16, 18, 20 into the mixer 12 to achieve the different layers. Toggling of the valve(s) 40, 42, 44, 46 instantaneously achieves a new ratio of materials 14, 16, 18, 20 within the mixer 12 and effectively creates layers 24, 26, 28, 30 within the part 60 without an index transition layer. The process has been described in relation to a number of pours 22 such as a first pour 22, second pour 22, third pour 22 and fourth pour 22. The use of these terms is to distinguish between the formation of the various layers 24, 26, 28 30 and it is to be understood that the pouring from the mixer 12 may be continuous without a stop upon transitioning from the first pour 22 to the second pour 22, second to third, third to fourth, etc. As such, the dispensing stream from the mixer 12 to the mold 10 may be continuous even at times when the pour 22 is changed such that the proportion of materials 14, 16, 18, 20 is changed.

While the present subject matter has been described in detail with respect to specific embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be apparent.

What is claimed is:

1. A casting method, comprising:

providing a mold;

providing a mixer, providing a first material for dispensing into the mixer;

providing a second material for dispensing into the mixer;

dispensing a first pour from the mixer into the mold;

dispensing a second pour from the mixer into the mold, wherein the first pour has different proportions of the first and second materials than the second pour, wherein the first pour forms a first layer of a molded part and wherein the second pour forms a second layer of the molded part;

wherein the mold is spun.

2. The method of claim 1, wherein the first pour includes the first material and the second material, and wherein the second pour includes the first material and the second material.

3. The method of claim 1, wherein the first pour includes the second material but does not include any of the first material, and wherein the second pour includes the first material and the second material.

4. The method of claim 1, further comprising:

injecting the first material into the mixer by way of a first injector;

injecting the second material into the mixer by way of a second injector; and mixing the first material and the second material in the mixer by use of a blade.

5. The method of claim 1, further comprising toggling a valve between an open and a closed position to cause the first material to be provided into and not provided into the mixer.

6. The method of claim 1, wherein the mold has a first piece separated from a radially outer second piece in a radial direction of the mold, wherein the mold has a void that extends from the first piece to the second piece in the radial direction, wherein the first pour is dispensed into the void before the second pour is dispensed into the void, wherein centrifugal force from the spinning of the mold causes the first pour to be applied and the first layer to be formed against the second piece along a majority of an axial length of the second piece in an axial direction of the mold.

7. The method of claim 1, further comprising:

providing a third material for dispensing into the mixer;

providing a fourth material for dispensing into the mixer;

wherein the mass of the second material, the third material, and the fourth material are the same as in the first pour as the second pour but the proportions are different as the first material is absent from the second pour.

8. The method of claim 7, wherein:

the first material is curative;

the second material is prepoly;

the third material is a catalyst diluted in curative;

the fourth material is colorant;

the first pour is dispensed before the second pour; and only two layers are formed in the molded part such that the first layer has a higher proportion of prepoly, catalyst diluted in curative and colorant than the second layer, wherein the first layer has a smaller proportion of the curative than the second layer and exhibits higher adhesion properties than the second layer, wherein the second layer has a higher proportion of the curative than the first layer and exhibits higher crack propagation resistance than the first layer.

9. The method of claim 7, further comprising:

dispensing a third pour from the mixer into the mold, wherein the third pour forms a third layer of the molded part;

dispensing a fourth pour from the mixer into the mold, wherein the fourth pour forms a fourth layer of the molded part;

wherein:

the first pour is dispensed before the second pour;

the second pour is dispensed before the third pour;

the third pour is dispensed before the fourth pour;

the fourth pour is dispensed after the first pour, the second pour, and the third pour;

the first material is curative;

the second material is prepoly;

the third material is a catalyst diluted in curative;

the fourth material is colorant;

only four layers are formed in the molded part such that the first layer and third layers have a higher proportion of prepoly, catalyst diluted in curative and colorant than the second layer and the fourth layer, wherein the first layer and the third layer have a smaller proportion of the curative than the second layer and the fourth layer and exhibit higher adhesion properties than the second layer and the fourth layer, wherein the second layer and the fourth layer have a higher proportion of the curative than the first layer and the third layer and exhibit higher crack propagation resistance than the first layer and the third layer.

10. The method of claim 1, wherein a pump creates pressure in the first material and the second material to urge the first and second materials to the mixer such that pressure of the pump is maintained even when an amount of the first material dispensed to the mixer is decreased by way of closing a valve to shut off the flow of the first material to the mixer.

11. The method of claim 10, further comprising recirculating the first material that does not flow past the valve when the valve is closed to maintain the same pressure on the first material.

12. The method of claim 1, wherein a pump is not used to force the first material or the second material to the mixer.

13. A casting method, comprising:

providing a mold;

providing a mixer, providing a first material for dispensing into the mixer;

providing a second material for dispensing into the mixer;

dispensing a first pour from the mixer into the mold;

dispensing a second pour from the mixer into the mold, wherein the first pour has different proportions of the first and second materials than the second pour, wherein the first pour forms a first layer of a molded part and wherein the second pour forms a second layer of the molded part;

providing a third material for dispensing into the mixer;

providing a fourth material for dispensing into the mixer;

wherein the mass of the second material, the third material, and the fourth material are the same as in the first pour as the second pour but the proportions are different as the first material is absent from the second pour;

wherein:

the first material is curative;

the second material is prepoly;

the third material is a catalyst diluted in curative;
the fourth material is colorant;
the first pour is dispensed before the second pour; and
only two layers are formed in the molded part such that the first layer has a higher proportion of prepoly, catalyst diluted in curative and colorant than the second layer, wherein the first layer has a smaller proportion of the curative than the second layer and exhibits higher adhesion properties than the second layer, wherein the second layer has a higher proportion of the curative than the first layer and exhibits higher crack propagation resistance than the first layer.

14. A casting method, comprising:
providing a mold;
providing a mixer,
providing a first material for dispensing into the mixer;
providing a second material for dispensing into the mixer;
dispensing a first pour from the mixer into the mold;
dispensing a second pour from the mixer into the mold, wherein the first pour has different proportions of the first and second materials than the second pour, wherein the first pour forms a first layer of a molded part and wherein the second pour forms a second layer of the molded part;
providing a third material for dispensing into the mixer;
providing a fourth material for dispensing into the mixer;
wherein the mass of the second material, the third material, and the fourth material are the same as in the first pour as the second pour but the proportions are different as the first material is absent from the second pour;
dispensing a third pour from the mixer into the mold, wherein the third pour forms a third layer of the molded part;
dispensing a fourth pour from the mixer into the mold, wherein the fourth pour forms a fourth layer of the molded part;
wherein:
the first pour is dispensed before the second pour;
the second pour is dispensed before the third pour;
the third pour is dispensed before the fourth pour;
the fourth pour is dispensed after the first pour, the second pour, and the third pour;
the first material is curative;
the second material is prepoly;
the third material is a catalyst diluted in curative;
the fourth material is colorant;
only four layers are formed in the molded part such that the first layer and third layers have a higher proportion of prepoly, catalyst diluted in curative and colorant than the second layer and the fourth layer, wherein the first layer and the third layer have a smaller proportion of the curative than the second layer and the fourth layer and exhibit higher adhesion properties than the second layer and the fourth layer, wherein the second layer and the fourth layer have a higher proportion of the curative than the first layer and the third layer and exhibit higher crack propagation resistance than the first layer and the third layer.

15. A casting method, comprising:
providing a mold;
providing a mixer,
providing a first material for dispensing into the mixer;
providing a second material for dispensing into the mixer;
dispensing a first pour from the mixer into the mold;
dispensing a second pour from the mixer into the mold, wherein the first pour has different proportions of the first and second materials than the second pour, wherein the first pour forms a first layer of a molded part and wherein the second pour forms a second layer of the molded part;
wherein a pump creates pressure in the first material and the second material to urge the first and second materials to the mixer such that pressure of the pump is maintained even when an amount of the first material dispensed to the mixer is decreased by way of closing a valve to shut off the flow of the first material to the mixer.

* * * * *